US010463157B1

(12) United States Patent
Liniado

(10) Patent No.: US 10,463,157 B1
(45) Date of Patent: Nov. 5, 2019

(54) PORTABLE FOLDING CHAIR

(71) Applicant: Marc Liniado, Brooklyn, NY (US)

(72) Inventor: Marc Liniado, Brooklyn, NY (US)

( * ) Notice: Subject to any disclaimer, the term of this patent is extended or adjusted under 35 U.S.C. 154(b) by 0 days.

(21) Appl. No.: 15/667,593

(22) Filed: Aug. 2, 2017

Related U.S. Application Data

(60) Provisional application No. 62/370,517, filed on Aug. 3, 2016.

(51) Int. Cl.
*A47C 7/72* (2006.01)
*A47C 1/14* (2006.01)
*A47C 4/28* (2006.01)

(52) U.S. Cl.
CPC ..... *A47C 7/72* (2013.01); *A47C 1/14* (2013.01); *A47C 4/28* (2013.01)

(58) Field of Classification Search
CPC ..... A47C 7/72; A47C 7/725; A47C 7/727; A47C 7/74; A47C 1/14; A47C 4/28
See application file for complete search history.

(56) References Cited

U.S. PATENT DOCUMENTS 4,650,245 A 3/1987 Nazar
4,925,245 A 5/1990 Pendleton et al.
5,628,544 A 5/1997 Goodman et al.
5,688,023 A 11/1997 Blocker, Jr.
5,829,832 A 11/1998 Molee et al.
6,000,752 A 12/1999 Shyr
6,036,262 A 3/2000 Shahid
6,135,551 A * 10/2000 Linder ..... A47C 4/54 297/217.4
6,179,381 B1 * 1/2001 Gevaert ..... A47C 7/72 297/217.3
6,721,430 B2 4/2004 Wang
RE39,022 E 3/2006 Welsh
7,438,356 B2 * 10/2008 Howman ..... A47C 7/021 297/17
8,002,349 B1 * 8/2011 Pizzuto ..... A47C 1/143 297/184.11
8,091,962 B2 1/2012 Quinn
8,262,244 B2 9/2012 Metcalf et al.
8,345,889 B2 1/2013 Li
8,388,056 B2 3/2013 Smith et al.
8,789,884 B1 7/2014 Edelman et al.
8,795,015 B1 8/2014 Nguyen
8,926,008 B1 1/2015 Al-Hasan
9,091,477 B2 7/2015 Magnus
9,124,308 B2 * 9/2015 Metcalf ..... A47C 7/70
9,185,988 B1 * 11/2015 Sanchez ..... A47C 7/66
9,247,818 B2 2/2016 Shively
9,375,092 B2 6/2016 Edelman et al.
2002/0070590 A1 6/2002 Carstens
2006/0082198 A1 4/2006 Mafrice et al.
(Continued)

*Primary Examiner* — Philip F Gabler
(74) *Attorney, Agent, or Firm* — Myers Wolin, LLC

(57) ABSTRACT

A portable folding chair is provided that contains electrical conduits within its structure for providing power to various accessories incorporated into the chair. The portable folding chair has a folding body support structure and a folding chair support structure which supports the body support structure, and a seat covering stretched between frame members, an electrical conduit either within the body support structure or within a fabric conduit within the seat covering for providing power to an accessory.

19 Claims, 12 Drawing Sheets

(56) References Cited

U.S. PATENT DOCUMENTS

| | | | | |
|---|---|---|---|---|
| 2009/0254011 | A1* | 10/2009 | Chi | A47C 7/72<br>601/134 |
| 2011/0109211 | A1 | 5/2011 | Kirkeby et al. | |
| 2012/0200129 | A1 | 8/2012 | Wilson, Jr. | |

* cited by examiner

PORTABLE FOLDING CHAIR

CROSS REFERENCE TO RELATED APPLICATION

The present application takes priority from Provisional Patent Application 62/370,517, filed Aug. 3, 2016, the entire contents of which are incorporated herein by reference.

FIELD OF THE INVENTION

The invention is in the field of portable folding chairs with integrated electronics.

BACKGROUND

Portable folding chairs, such as beach chairs, deck chairs, or other portable lounge chairs, are typically used as a central location around which user's enjoy an outdoor space. Accordingly, users often set up accessories, such as speaker systems, coolers, portable battery chargers, and massagers, for use while using such portable folding chairs. Many of these accessories are battery driven and require individual batteries for use.

In order to arrange accessories, users must separately pack and transport all such accessories, and must often charge separate battery packs for each such powered accessory.

There is a need for a portable folding chair that can integrate accessories ease of access and ease of use in an outdoor space. There is a further need that such portable folding chair be efficiently packaged such that all of the accessories fold with the chair into a compact configuration for travel.

SUMMARY

A portable folding chair is provided that contains electrical conduits within its structure for providing power to various accessories incorporated into the chair. The portable folding chair has a folding body support structure and a folding chair support structure which supports the body support structure, and a seat covering stretched between frame members, an electrical conduit either within the body support structure or within a fabric conduit within the seat covering for providing power to an accessory.

In some embodiments, where the electrical conduit is within the body support structure, it may transmit power from an interior of the first frame member to an interior of the second frame member. Such a conduit may be an electrical cable that extends partially into each of the first frame member and the second frame member.

In some embodiments, the electrical conduit may pass through a hinge between the first frame member and the second frame member. In such an embodiment, the hinge may comprise a central hole through which such an electrical conduit may pass.

In some such embodiments, a battery may be provided adjacent a first frame member and the electrical conduit may transmit power from the battery to the accessory.

DETAILED DESCRIPTION OF THE PREFERRED EMBODIMENTS

Figure 1:
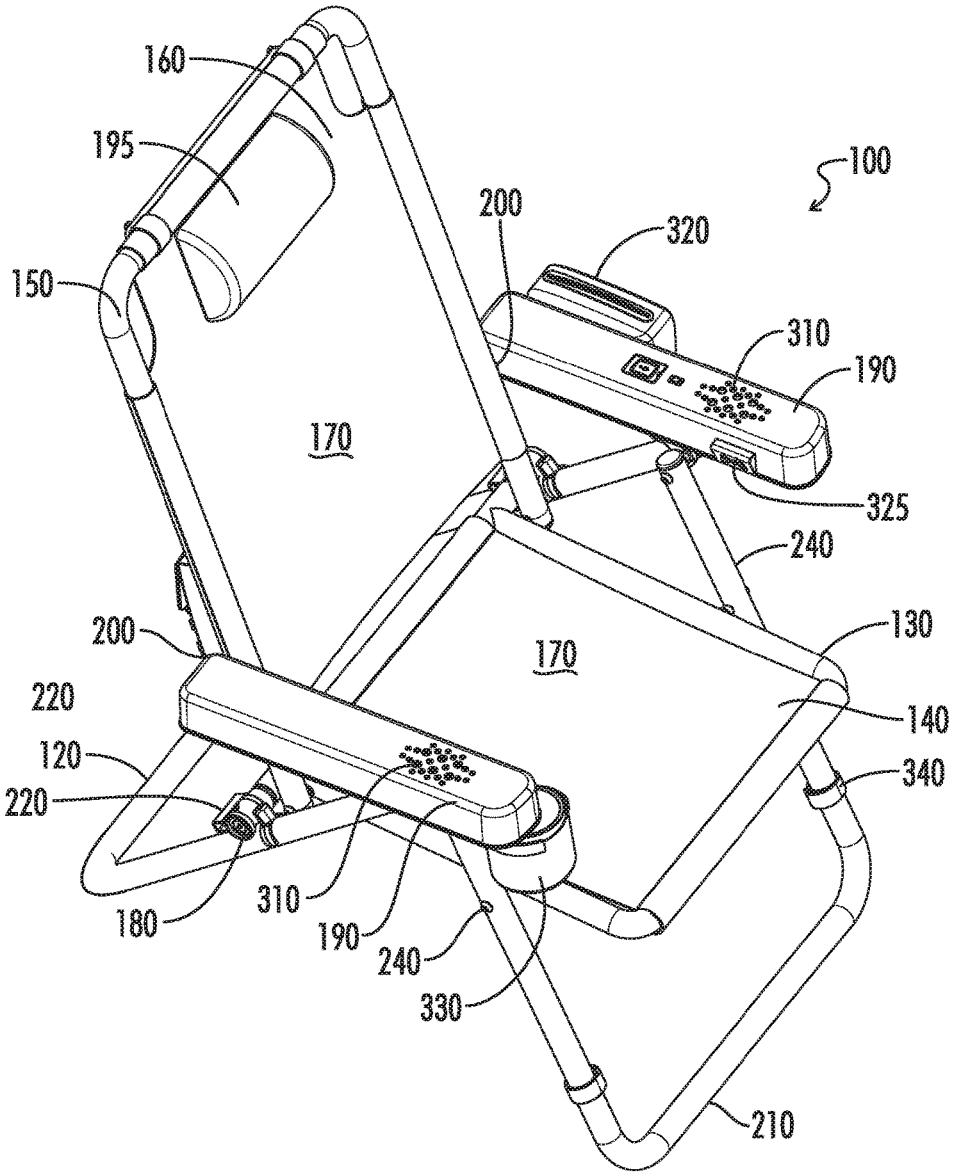
FIG. 1 is front perspective view of a folding chair in an unfolded configuration.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

This disclosure describes the best mode or modes of practicing the invention as presently contemplated. This description is not intended to be understood in a limiting sense, but provides an example of the invention presented solely for illustrative purposes by reference to the accompanying drawings to advise one of ordinary skill in the art of the advantages and construction of the invention. In the various views of the drawings, like reference characters designate like or similar parts.

A portable folding chair is provided that contains electrical conduits within its structure for providing power to various accessories incorporated into the chair. The folding chair is typically a lounge chair for use as a lawn chair or a beach chair, and typically has open and closed configurations. In an open configuration, the portable folding chair may have a reclining feature so as to modify the angle of a seat bottom or seat back. It will be understood that while the chair is shown in the form of a lawn chair or a beach chair, it may also take other forms, and, in some embodiments, the chair may fold in different ways than those shown. Some embodiments may provide additional configurations, such as additional reclining configurations.

Figure 2:
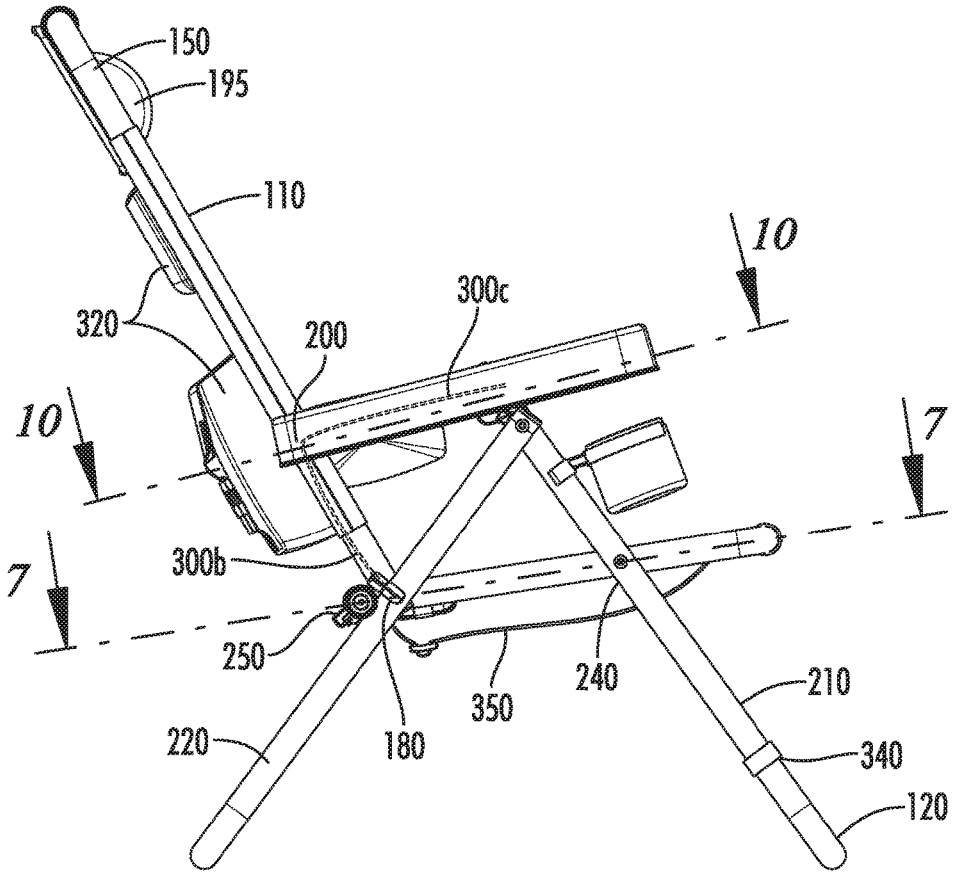
FIG. 2 is a side view of the folding chair of FIG. 1.
Figure 3:
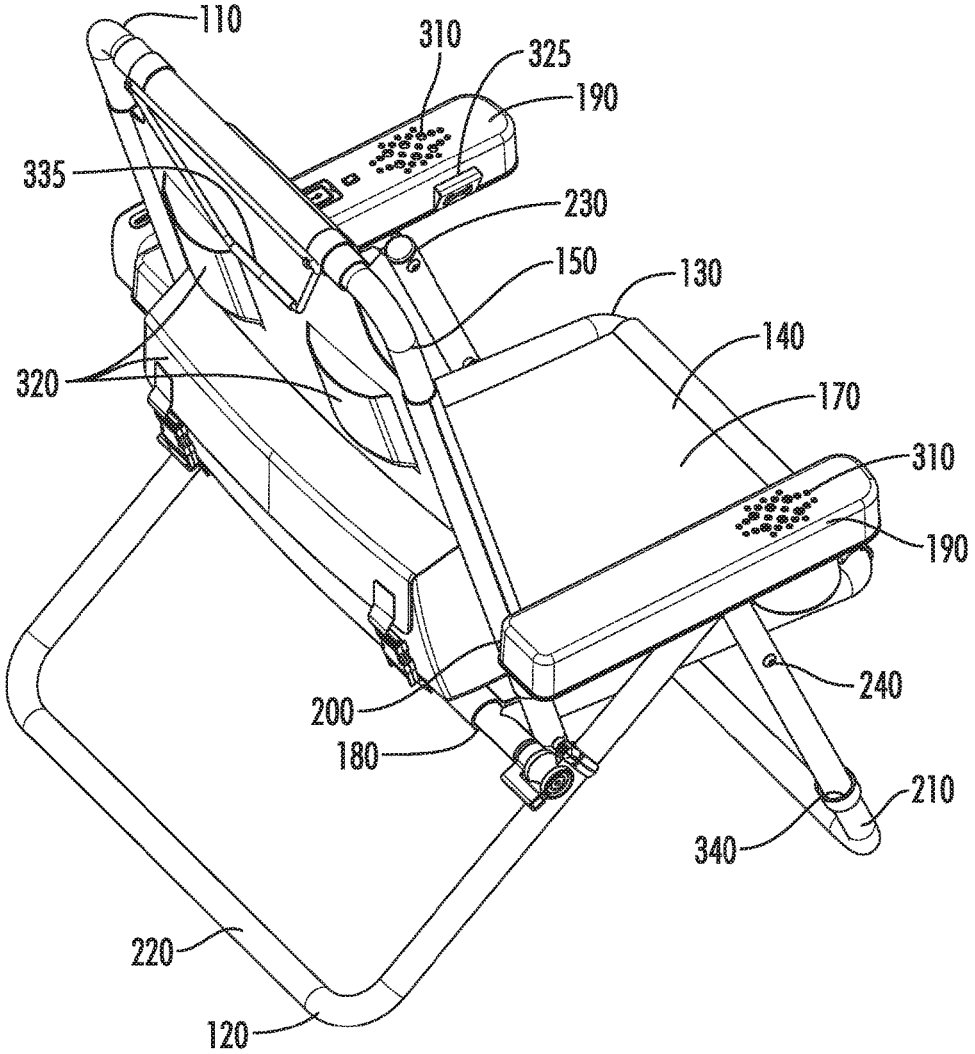
FIG. 3 is a back perspective view of the folding chair of FIG. 1.
Figure 4:
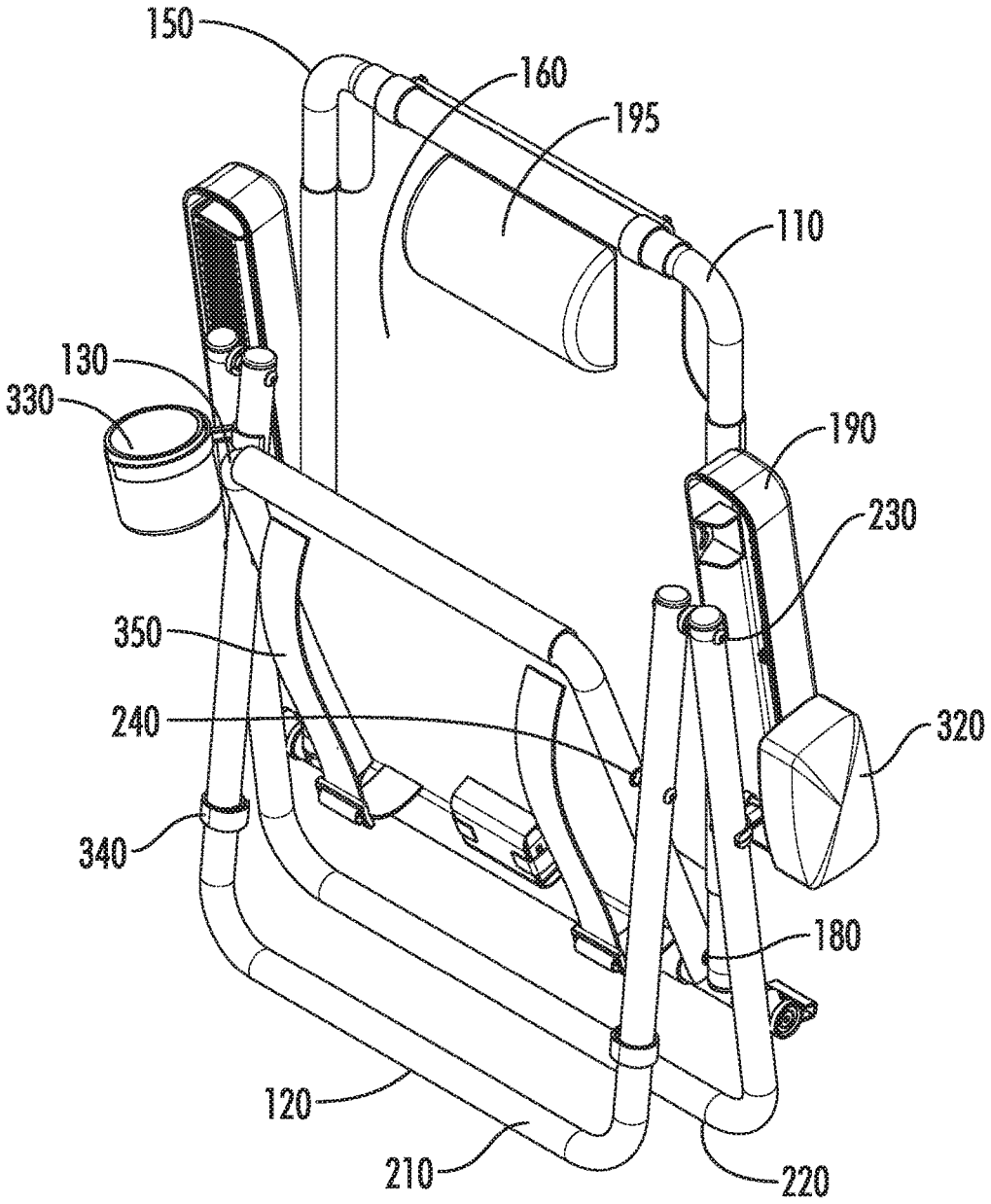
FIG. 4 is a front perspective view of the folding chair of FIG. 1 in a folded configuration.
Figure 5:
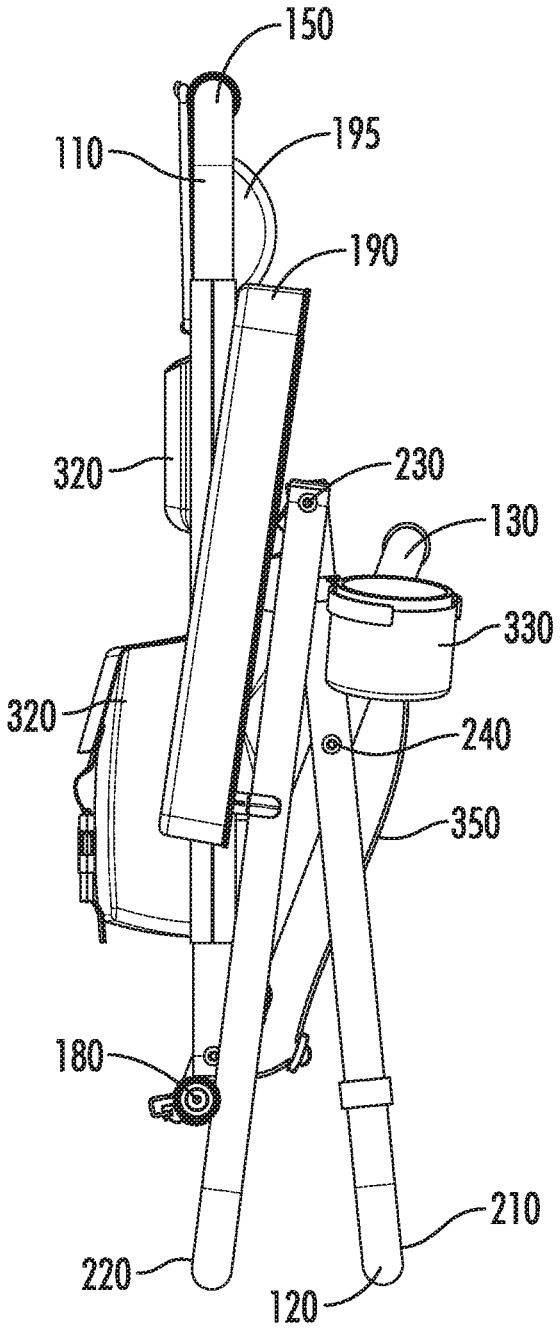
FIG. 5 is a side view of the folding chair of FIG. 1 in a folded configuration.
Figure 6:
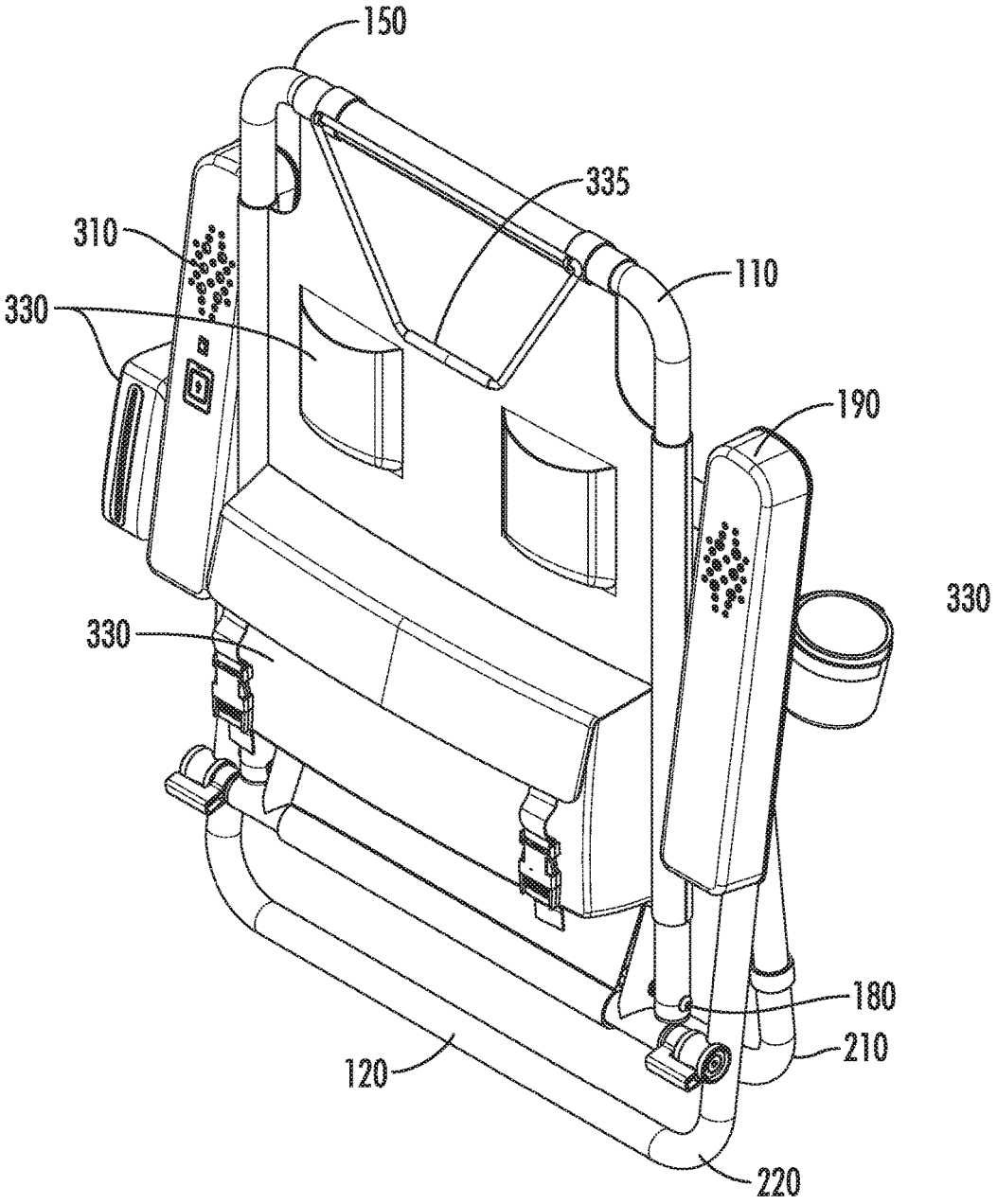
FIG. 6 is a back perspective view of the folding chair of FIG. 1 in a folded configuration.

FIGS. 1-3 show a folding chair 100 in an open configuration, in which it is usable as a chair, and FIGS. 4-6 show the folding chair in a folded configuration, in which it has been collapsed, such as for ease of storage and transportation. The chair comprises a folding body support structure 110 for supporting a user's body while sitting in the chair, and a folding chair support structure 120 for supporting the body support structure 110 when the chair is in an open configuration.

The body support structure 110 typically comprises a seat bottom and a seat back, and has a first frame member 130 that is a peripheral frame for the seat bottom 140 and a second frame member 150 that is a peripheral frame for the seat back 160. The first and second frame members 130, 150 may then have seat coverings 170 that stretch over the frame members to form the seat bottom 140 and seat back 160 respectively. Each of the first and second frame members 130, 150 may be tubular or otherwise hollow, such that they are lightweight, and so that they may have an interior space within which an electrical conduit 300 may be placed. Such an electrical conduit 300 is discussed in more detail below. The frame members 130, 150 may be formed from metal or plastic tubing, or some other stiff lightweight material.

The first frame member 130 and the second frame member 150 fold relative to each other, typically at pivot points along a first pivot axis 180, to transition the portable folding chair 100 from the open configuration shown in FIGS. 1-3 to the closed configuration shown in FIGS. 4-6. The body support structure 110 may further contain chair arms 190 which may connect to the second frame member 150 at arm pivot points 200, allowing it to transition between the open position and the closed position as well.

The body support structure 110 is supported by the folding chair support structure 120, which makes up a base of the chair and comprises a front support member 210 and a back support member 200. The support members 200, 210 are typically chair legs or other chair supports. The front and back support members 210, 220 fold relative to each other, typically at pivot points along a third pivot axis 230, to transition the portable folding chair from the open position to the closed position.

As shown, the folding chair support structure 120 typically connects to and supports the body support structure 110 at multiple points. In the embodiment shown, each chair arm 190 of the body support structure 110 rests on the pivot points along the third pivot axis 230, the first frame member 130 connects to the front support member 210 at pivot points along a fourth pivot axis 240, and the back support member 220 supports a rolling joint 250 that acts as a connection between the pivot point along the first pivot axis 180 and the back support member (described in more detail below with respect to FIGS. 8 and 12).

When transitioning the portable folding chair from the open configuration, shown in FIGS. 1-3, to the closed position, shown in FIGS. 4-6, the first and second frame members 130, 150 fold relative to each other at the first pivot axis 180 and the front and back support members 210, 220 fold relative to each other at the third pivot axis 230. In doing so, the chair arms 190 fold upwards toward the second frame member 150, the body support structure 110 pivots relative to the folding chair support structure 120 at the fourth pivot axis, and the rolling joint 250 moves along the back support member 220.

As shown, the body support structure 110 further has an electrical conduit 300 for providing power to at least one accessory 310 incorporated into the portable folding chair 100. The electrical conduit may be a single power cable for providing power to various devices, or it may be a bundle of wires for providing power from power sources to accessories and for transmitting electrical signals between components. In some embodiments, the electrical conduit may incorporate a cable harness for organizing and connecting various accessories, power sources, and controllers. Typically, the electrical conduit 300 is primarily within the various elements of the body support structure 110, and may have segments 300*a, b, c* inside each of the first frame member 130, the second frame member 150, and the chair arms 190 respectively. In some embodiments, the conduit 300 is entirely within a single element, such as where an electrical system is entirely contained within the chair arms. In other embodiments, such as in the embodiment shown, the electrical conduit 300 transmits power from one element to another, such as from an interior of the first frame member 130 to an interior of the second frame member 150 and from the interior of the second frame member 150 to the interior of the chair arm 190.

The accessory 310 may be, for example, a speaker, such as a Bluetooth speaker, a USB port, or a power outlet for charging battery powered devices incorporated into the chair arms 190, or it may be a neck pillow with a back massager 195 incorporated into the seat back 160, among other possibilities. As shown, multiple accessories may be provided in a given embodiment. While only powered accessories 310 are discussed herein as they relate to the electrical conduit 300, additional accessories are considered as well, such as the inclusion of pouches, pockets, and other storage compartments 320, a bottle opener, 325, a cup holder 330, and a retaining mechanism 335 for holding a towel. Such a retaining mechanism 335 may be, for example, a bungee cord combined with anchors incorporated into the seat back 160. Additional accessories may only be visible or usable when the portable folding chair 100 is in the folded configuration shown in FIGS. 4-6. For example, straps, such as Velcro® straps 340 may be provided for retaining the portable folding chair 100 in the folded configuration and carrying straps 350 may be incorporated to assist users with carrying the portable folding chair in its folded configuration.

Other accessories, not shown, are contemplated as well, such as a canopy, a water sprayer, a cooler, or an electric fan. In some embodiments, the accessories further include a controller, which may include a processor, for managing other accessories. Such a controller may be integrated into the chair, and may include a communication interface, such as Bluetooth or Wi-Fi, through which a user can interact with the controller. For example, a user may be able to connect with the controller using a smartphone, or other portable device, and may thereby use a smartphone to control various accessories integrated into the portable folding chair. In some embodiments, powered accessories 310 may be installed at various locations throughout the portable folding chair, such as speakers provided in both arms, each of which are provided with power via the electrical conduit 300.

In some embodiments, the powered accessories 310 provided may include charging accessories, such as a charging cable for charging an external power accessory, such as a smart phone. Alternatively, a charging base may be provided for supporting wireless charging for a portable electronic device, such as conductive charging or charging by Wi-Fi for a smartphone or tablet.

Figure 7:
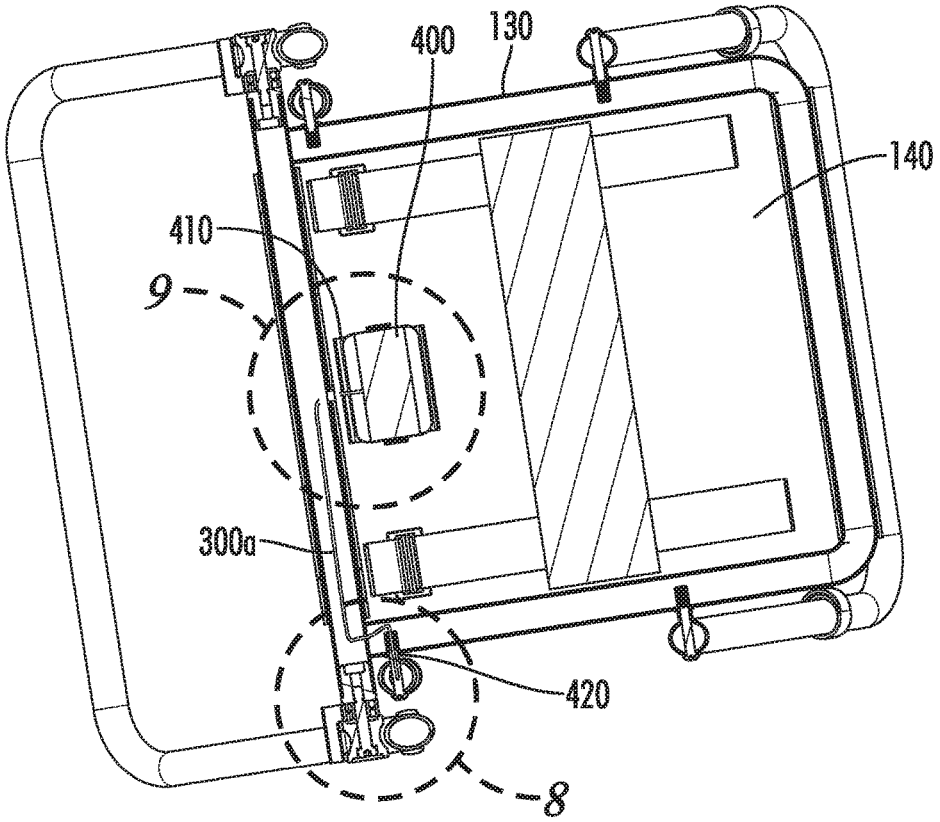
FIG. 7 is a section view of FIG. 2 taken along line 7-7.
Figure 8:
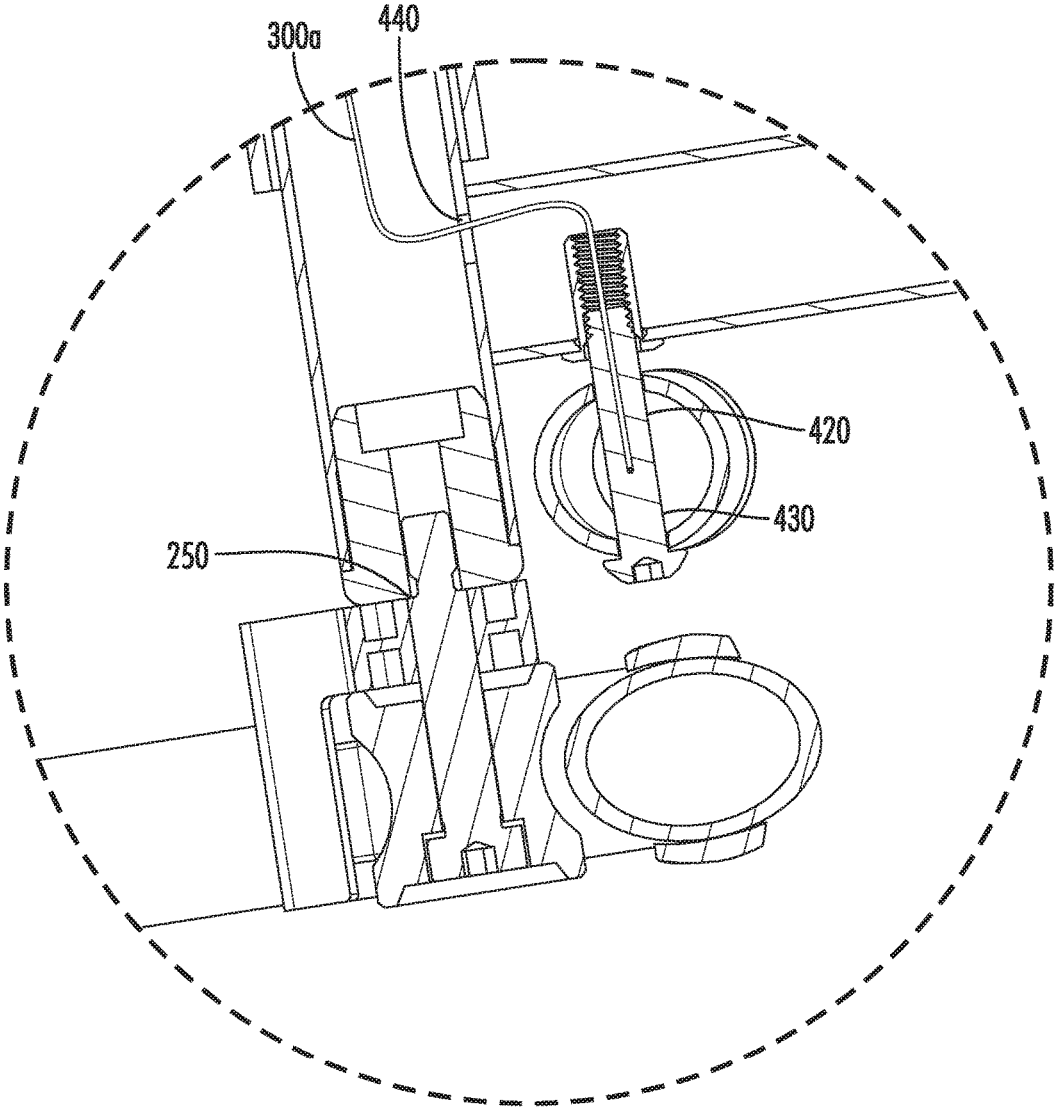
FIG. 8 is detailed view of section 8 of FIG. 7.
Figure 9:
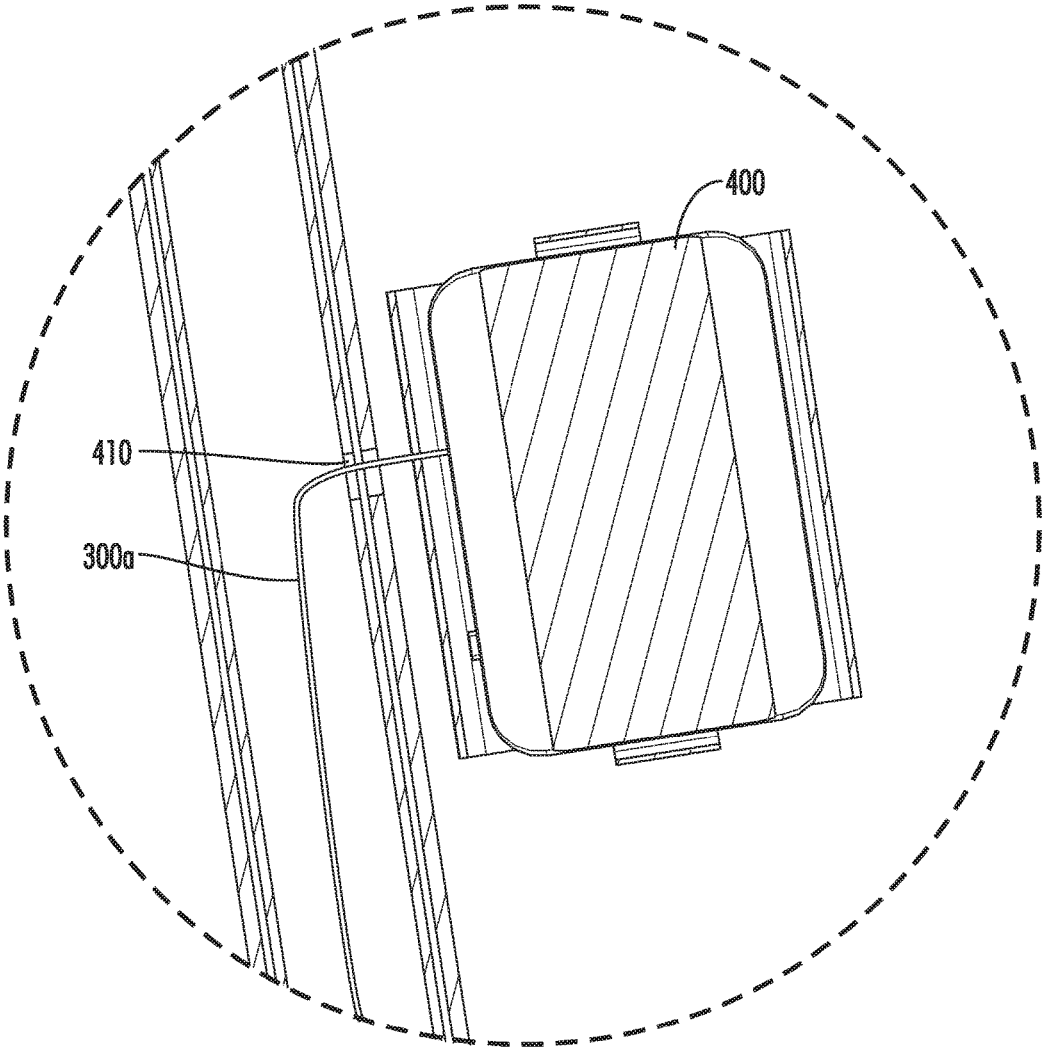
FIG. 9 is a detail view of section 9 of FIG. 7.

FIG. 7 is a section view of FIG. 2 taken along line 7-7, FIG. 8 is detailed view of section 8 of FIG. 7, and FIG. 9 is a detail view of section 9 of FIG. 7. FIG. 7 shows the plane of the first frame member 130, which is a peripheral frame for a seat bottom 140. As shown, a battery 400 is fixed to the seat bottom 140 adjacent the first frame member and provides power to the electrical conduit 300. The electrical conduit 300 may then draw power from the battery 400 and relay that power to the interior of the first frame member through bore 410. The battery 400 may be removable for charging external to the portable folding chair 100. For example, when the portable folding chair 100 is in storage, the battery 400 may be removed and charged at a wall outlet. Alternatively, the battery may be chargeable using a solar panel. In such an embodiment, a solar panel may be incorporated into the chair, such as in a canopy. Additional alternative energy sources are contemplated as well. For example, in some embodiments, a wind turbine may be provided to generate electricity to charge the battery.

While the battery 400 is shown mounted to the seat bottom 140, it may be fixed to the portable folding chair 100 at a different location, such as on the seat back 160 adjacent the second frame member 150.

The electrical conduit 300 may pass from the first frame member 130 into the second frame member 150 by passing through a segment of the rolling joint 250, or by a secondary joint mechanism 420 that works in concert with the rolling joint to fold the chair. The secondary joint mechanism may, for example, comprise a screw 430 with a hollowed section for allowing the electrical conduit 300 to pass. Accordingly, the first frame member 130 and the second frame member 150 may pivot relative to each other at the secondary joint mechanism, while the hollowed section of the screw allows the electrical conduit to pass through in either configuration. In some embodiments, additional bores 440 allow the electrical conduit 300 to pass from one section of a frame member 130, 150 to a second section of the frame member.

In some embodiments, the electrical conduit 300 may leave the first frame member 130 at a bore adjacent the secondary joint mechanism 420 and may enter the second frame member 150 at another bore adjacent the secondary joint mechanism. In such embodiments, an otherwise exposed portion of the electrical conduit 300 may be contained in a secondary conduit, such as a flexible rubber tube, that encloses the electrical conduit 300 when it is outside of the frame members.

Figure 10:
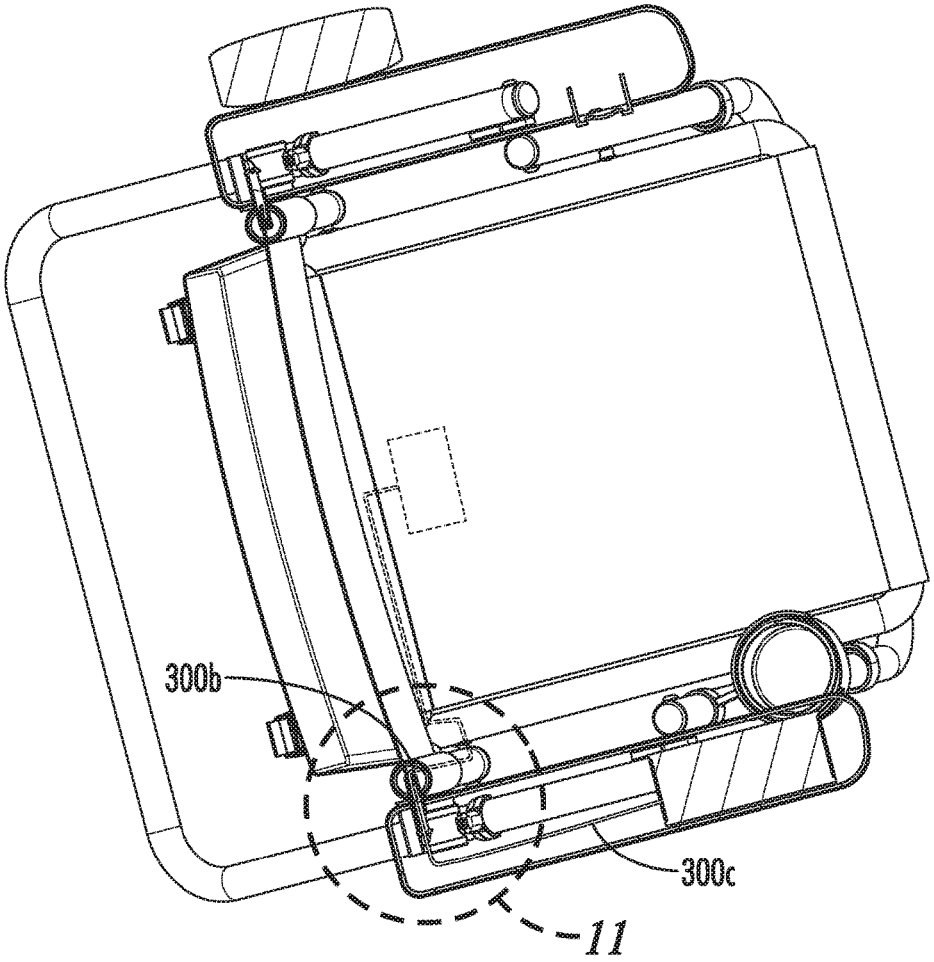
FIG. 10 is a section view of FIG. 2 taken along line 10-10.
Figure 11:
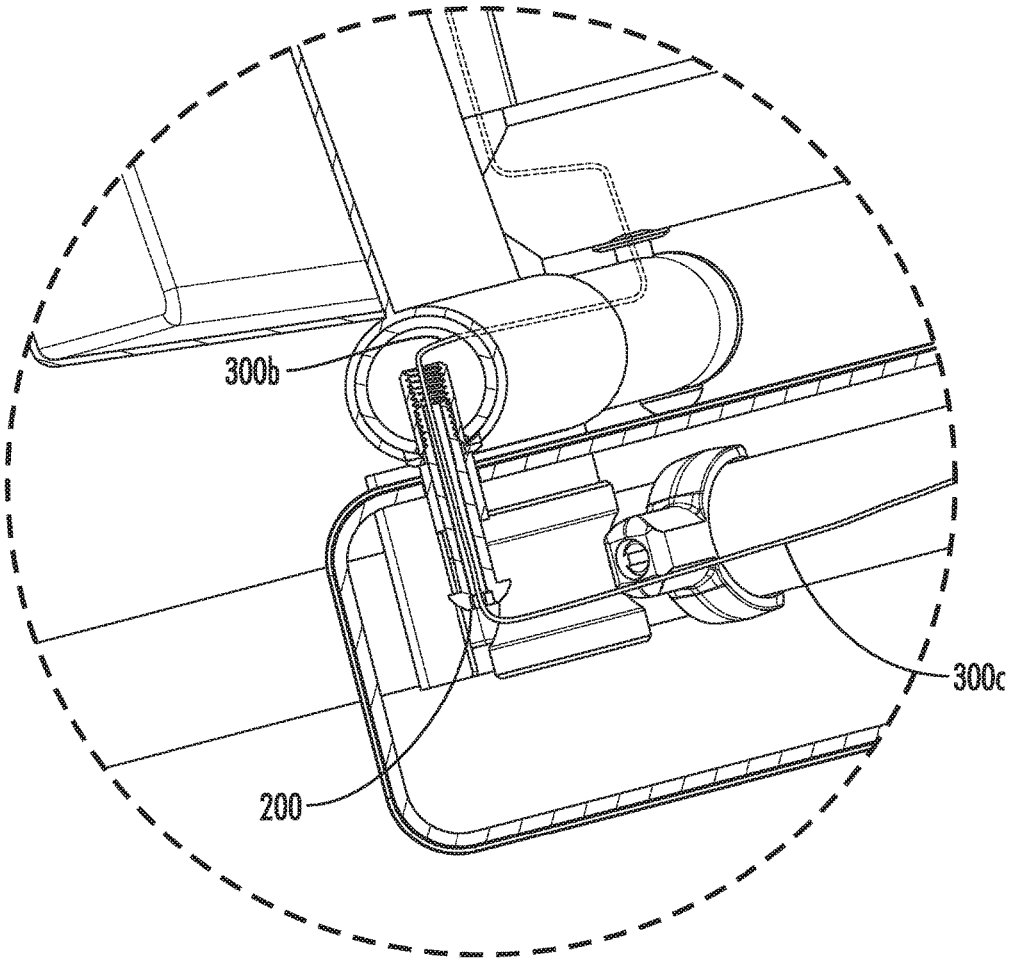
FIG. 11 is a detail view of section 11 of FIG. 10.

FIG. 10 is a section view of FIG. 2 taken along line 10-10 and FIG. 11 is a detail view of section 11 of FIG. 10. The electrical conduit 300 follows a path through the second frame member 150 and enters the chair arms 190 through a joint at one of the arm pivot points 200. Accordingly, a third segment of the electrical conduit 300*c* enters at least one of the chair arms 190 to power the various powered accessories 310 that reside therein, such as Bluetooth speakers.

As discussed above with respect to the secondary joint mechanism 420, the joint at the arm pivot point 200 may include a hollow screw through which the electrical conduit may exit the second frame member 150 and enter the chair arm 190. Alternatively, the electrical conduit 300 may leave the second frame member 150 through a bore adjacent the arm pivot point 200 and enter the chair arm 190 through a separate bore, and the exposed section of the electrical conduit 300 may be contained within a secondary conduit, such as a flexible rubber tube.

In some embodiments, additional powered accessories may be provided outside of the chair arms 190, such as the back massager 195 incorporated into the seat back 160. In such embodiments, a portion of the electrical conduit 300 may extend further along the second frame member and emerge through a bore in a portion of the second frame member adjacent the back massager 195 to provide power to the back massager. Further, a portion of the electrical conduit 300 may then extend from the back massager through the second frame member 150, and into the chair arm 190 in order to provide a controller for the back massager 195 in the chair arm.

While the electrical conduits are described as within the frame members, in some embodiments, the electrical conduits 300 may run within a segment of the seat coverings 170 stretched between frame members or within other fabric components. In such embodiments, fabric conduits may be included in the seat coverings 170, such as conduits sewn adjacent edges of the seat coverings, and the electrical conduits 300 may run within fabric conduits. Such electrical conduits 300 may then run entirely within the fabric conduits, or may pass between the fabric conduits and the frame members. Such fabric conduits may run adjacent frame members within the fabric, such that users of the chair would not be sitting on the electrical conduits 300 during use.

Figure 12:
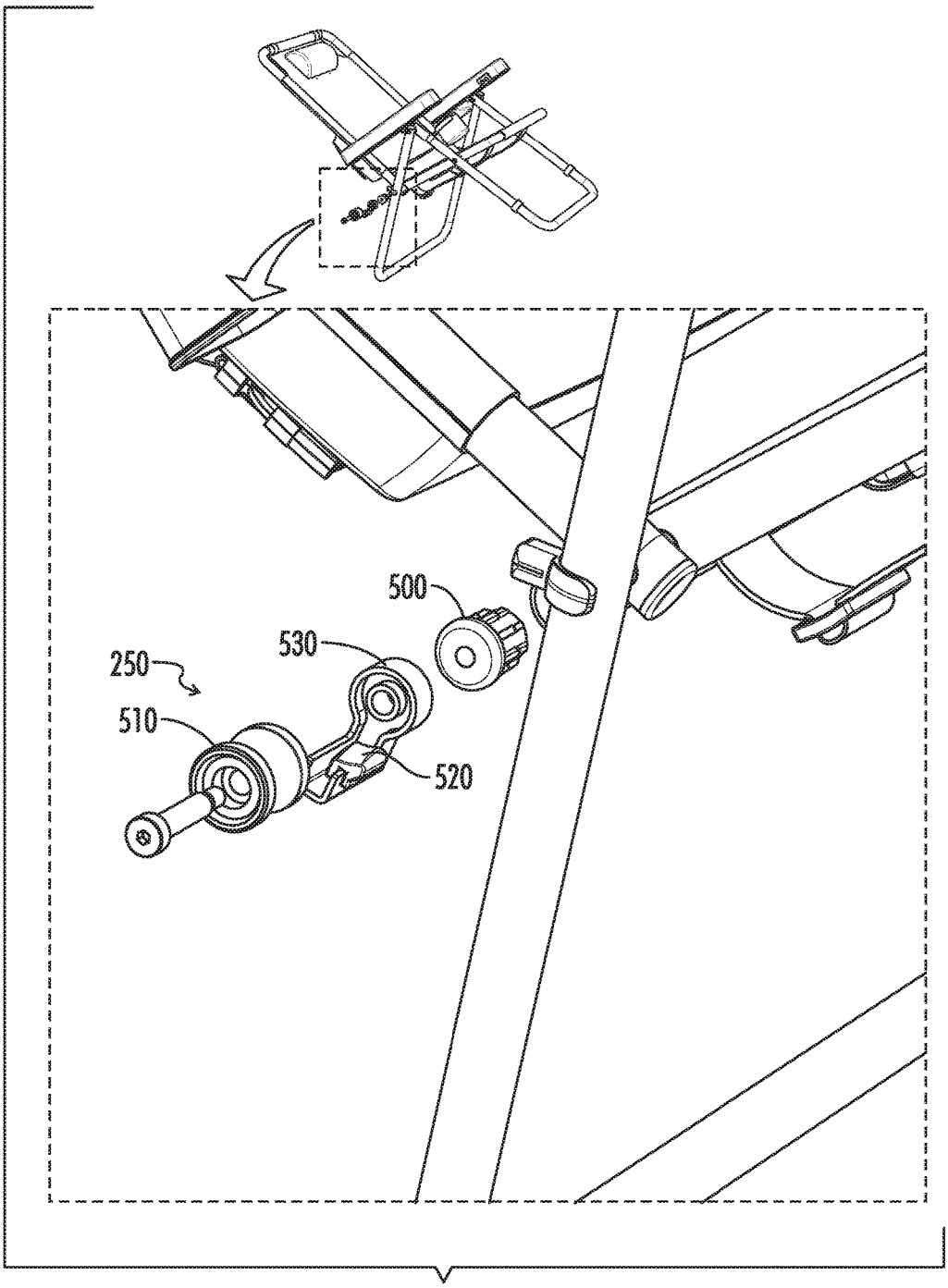
FIG. 12 is an exploded view of a rolling joint used in the folding chair of FIG. 1.

FIG. 12 is an exploded view of a rolling joint 250 used in the portable folding chair of FIG. 1. As shown, the rolling joint may comprise a pipe insert segment 500, a pulley mechanism 510, and a brake shoe 520. The pipe insert segment is inserted into an opening, such as a pipe end, that is part of the first frame member 130. Typically, the pipe insert segment utilizes a press fit such that it is not rotatable relative to the pipe in which it inserted. The pulley mechanism 510 then rolls along the second frame member 150 and rotates relative to the pipe insertion segment 500. The rolling joint is provided with a brake bracket 530 that rotates with the pulley mechanism 510 and holds the brake shoe 520. Accordingly, when the portable folding chair is transitioned from its closed configuration to its open configuration, the pulley mechanism 510 rolls along the second frame member 150 and rotates the brake bracket 530 until the brake shoe comes in contact with the second frame member and prevents the pulley mechanism 510 from rotating further.

Accordingly, a portable folding chair 100 is provided that easily transitions from a open configuration a collapsed configuration, and is stabilized by the rolling joint 250 when in its open configuration. The chair provides an electrical conduit 300 transmitting power from a battery 400 mounted in one location on the chair to accessories 310 mounted elsewhere on the chair. The electrical conduit 300 may also transmit control signals to allow users to control the various accessories 310 provided.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention. Furthermore, the foregoing describes the invention in terms of embodiments foreseen by the inventor for which an enabling description was available, notwithstanding that insubstantial modifications of the invention, not presently foreseen, may nonetheless represent equivalents thereto.

What is claimed is:

1. A portable folding chair comprising:

a folding body support structure;

a folding chair support structure which supports the body support structure; and an electrical conduit within the body support structure for providing power to an accessory, wherein the folding body support structure interfaces with the folding chair support structure at a rolling joint comprising a pulley and a brake shoe, and wherein the pulley rolls along a component of the folding chair support structure when transitioning the portable folding chair from a closed configuration to an open configuration, and the brake shoe retains the portable folding chair in an open configuration.

2. The portable folding chair of claim 1 wherein the folding body support structure comprises:

a first frame member; and a second frame member foldably connected to the first frame member, wherein the electrical conduit transmits power from an interior of the first frame member to an interior of the second frame member.

3. The portable folding chair of claim 2 wherein the electrical conduit is an electrical cable that extends partially into the first frame member and partially into the second frame member.

4. The portable folding chair of claim 3 wherein the electrical conduit is connected to a power source adjacent the first frame member and transmits power via the first frame member and the second frame member to the accessory.

5. The portable folding chair of claim 2 wherein the first frame member is pivotally connected to the second frame member at a hinge, and the hinge comprises at least a portion of the electrical conduit.

6. The portable folding chair of claim 2 wherein the first frame member is pivotally connected to the second frame member at a hinge, and wherein the hinge comprises a central hole through which an electrical conduit passes.

7. The portable folding chair of claim 2 wherein the first frame member is a peripheral frame for a seat bottom and the second frame member is a peripheral frame for a seat back.

8. The portable folding chair of claim 7 wherein a battery is mounted on the seat bottom adjacent the first frame member, and wherein the electrical conduit connected to the battery enters the first frame member at a bore adjacent the battery.

9. The portable folding chair of claim 7 wherein the electrical conduit connects to a back massager in or on the seat back.

10. The portable folding chair of claim 9 further comprising a chair arm connected to the second frame member, and wherein the electrical conduit connects to the back manager on the seat back and a controller for the back massager on the arm.

11. The portable folding chair of claim 2 wherein a first portion of the electrical conduit is internal to the first frame member, a second portion of the electrical conduit is internal to the second frame member and a third portion of the electrical conduit between the first portion and the second portion is external to first frame member and the second frame member.

12. The portable folding chair of claim 11 wherein a secondary conduit connects the first frame member to the second frame member and contains the third portion of the electrical conduit, and wherein the secondary conduit is a flexible tube and the electrical conduit is an electrical cable.

13. The portable folding chair of claim 1 wherein the folding body support structure comprises a chair arm, and wherein the electrical conduit is at least partially within the chair arm, and wherein the chair arm further contains the accessory.

14. The portable folding chair of claim 13 wherein the accessory is a USB port or a speaker mounted inside the arm.

15. The portable folding chair of claim 1 wherein the accessory is a wireless charger for a portable electronic device.

16. A portable folding chair comprising:

a first frame member;

a second frame member foldably connected to the first frame member; and an electrical conduit;

wherein the electrical conduit transmits power from an interior of the first frame member to an interior of the second frame member wherein the first frame member interfaces with the second frame member at a rolling joint comprising a pulley and a brake shoe, and wherein the pulley rolls along a component of the second frame member when transitioning the portable folding chair from a closed configuration to an open configuration, and the brake show retains the portable folding chair in an open configuration.

17. The portable folding chair of claim 16 further comprising:

a battery adjacent the first frame member; and an accessory adjacent the second frame member; and wherein the electrical conduit transmits power from the battery to the accessory.

18. A portable folding chair comprising:

a folding body support structure;

a folding chair support structure which supports the body support structure;

a seat covering stretched between frame members of the folding body support structure; and fabric conduits within the seat covering, wherein an electrical conduit within the fabric conduits provides power from a battery to an accessory, wherein the folding body support structure interfaces with the folding chair support structure at a rolling joint comprising a pulley and a brake shoe, and wherein the pulley rolls along a component of the folding chair support structure when transitioning the portable folding chair from a closed configuration to an open configuration, and the brake shoe retains the portable folding chair in an open configuration.

19. The portable folding chair of claim 18, wherein the fabric conduits are adjacent the frame members of the folding body support and the accessory is a wireless charging unit for charging a portable electronic device.

* * * * *